United States Patent [19]

Goyer

[11] Patent Number: 4,546,972

[45] Date of Patent: Oct. 15, 1985

[54] TWO-POSITION PIVOT SUPPORT STRUCTURE FOR A TILTABLE BODY EXERCISER

[75] Inventor: Norman E. Goyer, Apple Valley, Calif.

[73] Assignee: Leslie Kovats, Hollywood, Calif.

[21] Appl. No.: 568,931

[22] Filed: Jan. 11, 1984

[51] Int. Cl.[4] ..... A63B 17/00

[52] U.S. Cl. ..... 272/145; 272/144

[58] Field of Search ..... 128/70, 71, 74, 75; 272/144, 145, 109; 269/322-326; 211/208, 169.1, 173

[56] References Cited

U.S. PATENT DOCUMENTS

| | | | |
|---|---|---|---|
| 3,081,085 | 3/1963 | Girolamo | 272/145 X |
| 3,152,802 | 10/1964 | Heisler et al. | 128/71 |
| 3,286,708 | 11/1966 | Gartner | 272/145 X |
| 3,568,669 | 3/1971 | Stites | 128/71 |
| 3,589,358 | 6/1971 | Megal | 128/71 |
| 4,170,988 | 11/1977 | Krause | 128/24 R |
| 4,232,662 | 11/1980 | Barber | 128/71 |

*Primary Examiner*—Richard J. Apley
*Assistant Examiner*—James Prizant
*Attorney, Agent, or Firm*—B. F. Spencer

[57] ABSTRACT

A two-position pivot support structure is disclosed for enabling a tiltable body exerciser to be tilted about a first or a second horizontally extending pivot axis, the first and second horizontally extending pivot axes being laterally spaced apart. The support structure includes an A-frame stand having left and right pairs of leg members mechanically intercoupled and mounting left and right trunion supporting plates. A first pair of left and right U-shaped trunion receiving slots and a second pair of left and right U-shaped trunion receiving slots are located, respectively, in the left and right trunion supporting plates. A stop member is mechanically joined between the front legs of the A-stand. With the left and right trunions of the tiltable body exerciser positioned, respectively, in the first pair of left and right trunion receiving slots, the tiltable body exerciser is operable to tilt the human body in an inclined, inverted and unlocked body position. With the left and right trunions positioned, respectively, in the second pair of left and right trunion receiving slots, the tiltable body exerciser is operable to tilt the human body in an inverted, locked, body position.

5 Claims, 4 Drawing Figures

PRIOR ART

TWO-POSITION PIVOT SUPPORT STRUCTURE FOR A TILTABLE BODY EXERCISER

BACKGROUND OF THE INVENTION

The present invention relates to tiltable body exercisers and, in particular, to a two-position pivot support system for such exercisers.

Tiltable body exercisers are well known in the art. These exercisers consist of a body supporting structure pivotally mounted for tilting movement about a horizontally extending pivot axis. The body supporting structure includes an upper body supporting portion, i.e., a bed or platform; a lower body supporting portion, i.e., a foot, ankle, instep or leg embracing structure; and an elongated central frame member, or boom, interconnecting the upper and lower body supporting portions. Representative examples of tiltable body exercisers are disclosed in U.S. Pat. Nos. 3,081,085; 3,152,802; 3,286,708; 3,568,669; 3,589,358; 4,170,988 and 4,232,662.

Tiltable body exercisers may be supported for tilting movement, about the horizontally extended pivot axis, upon a sturdy A-frame stand or similar structure. The A-frame stand includes spaced-apart, left and right pairs of leg members mechanically intercoupled at their upper ends. The lower portions of the front, left and right leg members are mechanically joined together by a horizontally extending member or bar, and the rear, left and right leg members are mechanically joined together at their lower ends. The A-frame stand may be foldable for easy storage by left and right foldable linkage members mechanically intercoupled, respectively, between the left and right pairs of leg members.

The tiltable body exerciser may include centrally located left and right oppositely extending trunions, securely attached to the bed or platform by means of left and right bracket members. The lower ends of the left and right bracket members are secured, respectively, to the left and right sides of the bed, and the bracket members extend upwardly from the plane of the bed. The upper ends of the left and right bracket members support the left and right, oppositely extending trunions, respectively. The length of the left and right bracket members may be made adjustable by means of interlocking parts in order to selectively adjust the perpendicular distance between the plane of the bed and the horizontal pivot axis of the left and right trunions.

The left and right trunions are pivotally supported, respectively, within left and right trunion supporting plates, as by bushings, notches or slots. The left and right trunion supporting plates are securely attached to the upper end portions of the left and right pairs of leg members and form an integral part of the A-frame stand. The horizontally extending axis of the bushings, notches or slots within the left and right trunion supporting plates defines the horizontally extending axis about which the exerciser is tiltable.

With the left and right trunions secured in place in their respective trunion supporting plates of the A-frame, and the tiltable body exerciser ready for use, the lower end of the central frame member will rest upon the floor, as shown and described in the above-mentioned U.S. Pat. No. 4,232,662. In this position, the center of gravity of the tiltable body exerciser itself lies below and somewhat forward of the horizontally extending pivot axis about which the exerciser is to be tilted.

A user, secured in position on the tiltable body exerciser, may achieve horizontal, inclined or inverted positions of the body by adjusting the position of the center of gravity of the combined weights of the user and the exerciser relative to the horizontally extending pivot axis. For example, in a stable, balanced horizontal body position, with the arms of the user along the sides of the body, the center of gravity of user and exerciser will lie in a vertical plane at a point directly below the horizontally extending pivot axis. If, from this stable and balanced horizontal position, the user moves his arms to a fixed position above his head, a stable, balanced inclined position may be achieved with the feet and legs of the user elevated above the head. In this stable, balanced and inclined position, the position of the center of gravity of user and exerciser will, again, lie in a vertical plane at a point directly below the horizontally extending pivot axis.

Tiltable body exercisers are provided with stop means for limiting the angle of inclination of the exerciser relative to the horizontal plane. A limit to the inverted position of the exerciser is necessary before the user can achieve stable, inverted body position. One method for providing a limit stop is to locate the position of the horizontal bar or member, joined between the front left and right leg members of the A-frame, so that it will engage and bear against the rear of the bed or platform when the bed or platform is in the fully inverted position. The horizontal bar or member may be padded or spring-loaded to minimize the shock caused when the rear or back side of the bed strikes the horizontal bar. When the user is in a fully inverted position on the tiltable body exerciser, with the rear of the bed resting firmly against the horizontal bar limit stop, the user may be said to be in an inverted and unlocked position, or he may be in an inverted and locked position, as will be explained hereinafter.

A principal object of the present invention is to provide a tiltable body exerciser whose pivot axis is capable of being shifted from a first position, providing an inverted and unlocked body position, to a second position, providing an inverted and locked body position.

Another object of the invention is to provide an improved supporting structure for pivotally supporting a tiltable body exerciser about either one of two spaced-apart horizontal pivot axes.

Yet another object is to provide a supporting structure for a tiltable body exerciser that will enable the exerciser to be inverted to either one of two different, inverted, limited positions.

The above objects of and the brief introduction to the present invention will be more fully understood, and further objects and advantages will become apparent, from a study of the following detailed description in connection with the drawings.

DESCRIPTION OF THE INVENTION

Figure 1:
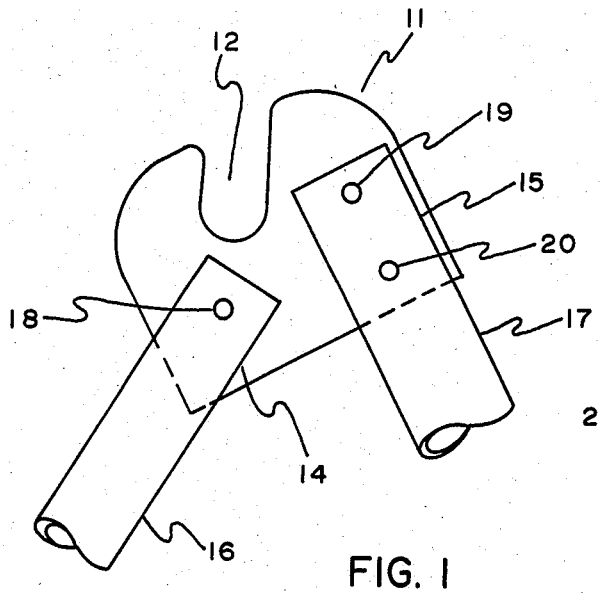
FIG. 1 is a side view of a prior art trunion supporting plate for pivotally supporting a tiltable body exerciser.

Referring to FIG. 1, a prior art trunion supporting plate 11, having a U-shaped notch or slot 12, is shown attached to the upper end portions 14 and 15 of a left pair of leg members 16 and 17 of a conventional A-frame stand. The front left leg member 16 is pivotally attached to trunion supporting plate 11 by a single rivet 18. The rear left leg member 17 is secured to plate 11 by two rivets 19 and 20. Only the upper end portions of leg members 16 and 17 are shown, it being understood that an identical trunion supporting plate, similarly attached to the upper end portions of a right pair of leg members, is required to form a free standing, sturdy A-frame. The conventional A-frame stand for pivotally supporting the pair of oppositely extending trunions of the conventional tiltable body exerciser employs left and right trunion supporting plates 11 as shown in FIG. 1.

Figure 2:
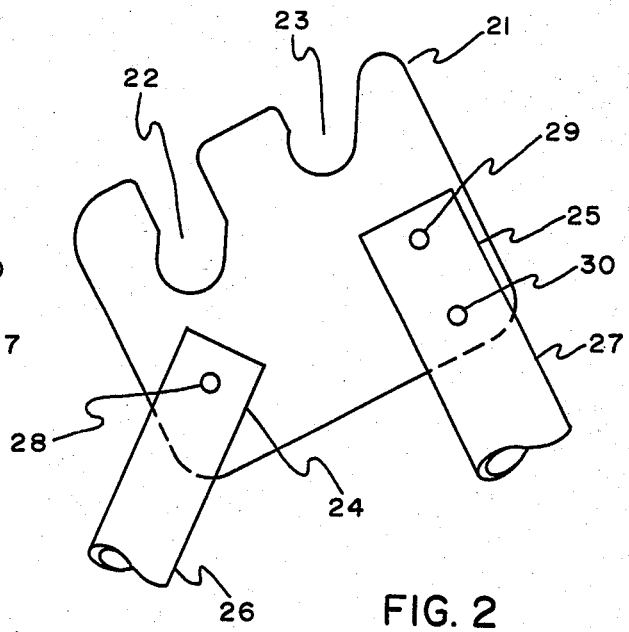
FIG. 2 is a side view of one embodiment of the trunion supporting plate of the present invention.

FIG. 2 illustrates one embodiment of the trunion supporting plate 21 of the invention. Trunion plate 21 is provided with a first U-shaped trunion receiving notch or slot 22 and a second U-shaped trunion receiving notch 23 spaced apart from and located above slot 22. Trunion support plate 21 is attached to the upper end portions 24 and 25 of a left pair of leg members 26 and 27 of an A-frame stand, in the same general manner as described above in connection with FIG. 1, by rivets 28, 29 and 30. An identical trunion supporting plate is similarly attached to the upper end portions of a right pair of leg members to form a sturdy A-frame.

The notch or slot 22 in trunion supporting plate 21, with its matching slot in the trunion plate attached to the right pair of leg members, defines a first horizontally extending pivot axis about which a tiltable body exerciser may be tilted. Notch or slot 23, with its matching slot, defines a second horizontally extending pivot axis, spaced apart from and parallel to the first horizontally extending axis.

Figure 3:
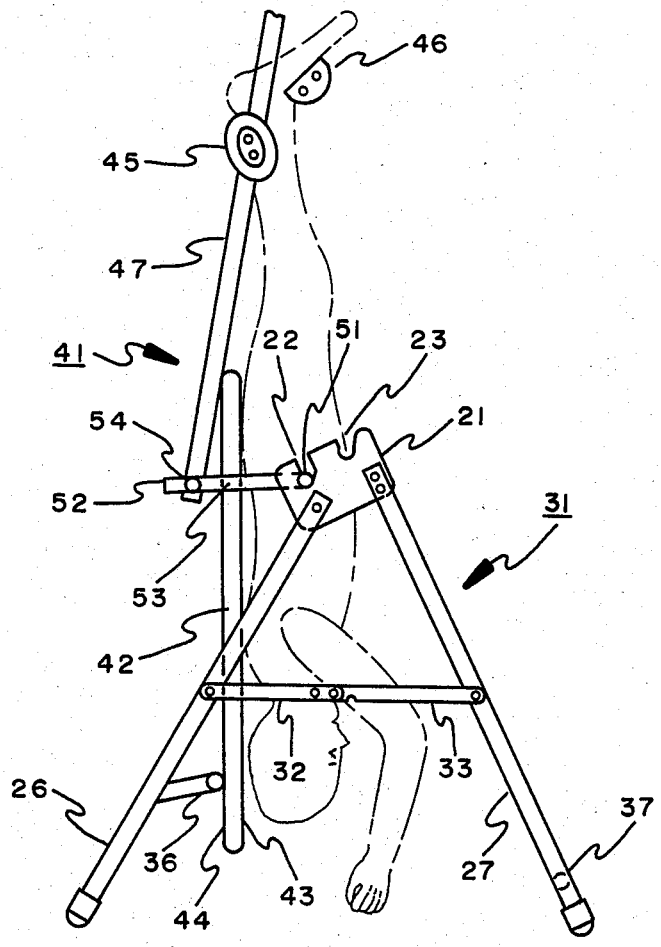
FIG. 3 is a side view of the two-position pivot supporting structure showing the tiltable body exerciser in the inverted and unlocked position.
Figure 4:
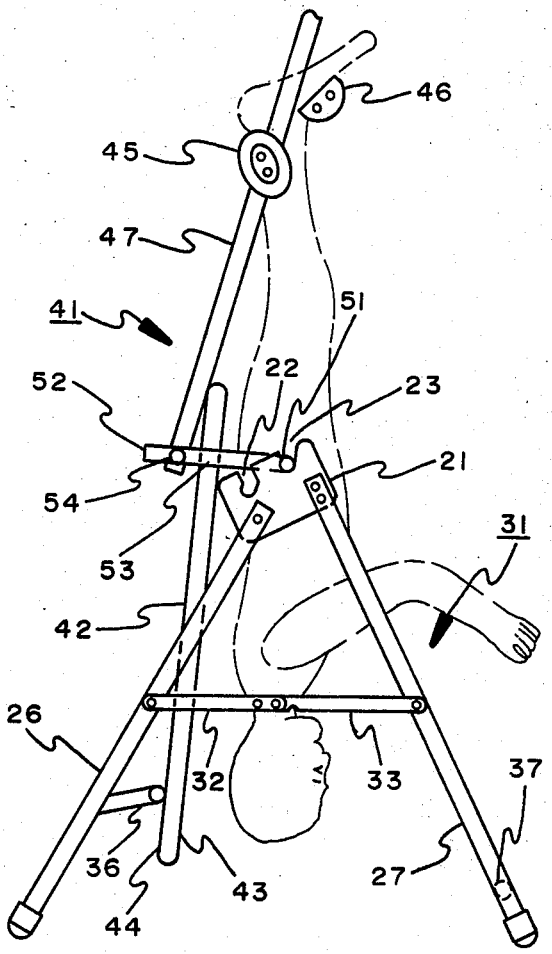
FIG. 4 is a side view of the two-position pivot supporting structure showing the tiltable body exerciser in the inverted, locked body position.

FIGS. 3 and 4 illustrate a conventional tiltable body exerciser pivotally supported upon an A-frame 31 having trunion supporting plates 21, as described in connection with FIG. 2. A-frame 31 includes conventional foldable linkage members 32 and 33 pivotally intercoupled between the left pair of leg members 26 and 27. Identical foldable linkage members are pivotally intercoupled between the right pair of leg members of A-frame 31.

A horizontally extending bar or member 36 is securely attached between the two front left and right legs 26 of A-frame 31. Horizontal bar 36 serves to rigidly join the two front legs 26 together and form an integral part of A-frame 31. Another horizontal member or rod 37, shown in dotted lines, rigidly joins the two rear legs 27 together to form an integral part of A-frame 31.

The tiltable body exerciser 41 includes a bed or platform 42 having a front or top surface 43 and a rear surface 44; an ankle and instep holding structure 45 and 46; and a central frame member 47, one end of which supports the ankle and instep holding structure 45 and 46 while the other end portion supports the bed or platform 42.

Exerciser 41 is pivotally mounted upon A-frame 31 by means of left and right oppositely extending trunions 51 which are shown positioned within the first pair of U-shaped slots 22 in trunion support plates 21 of FIG. 3. Trunions 51 are rigidly mounted to the right hand ends of bracket members 52, the axis of the trunions extending horizontally. The central portions 53 of bracket members 52 may be rigidly attached to the left and right sides, respectively, of bed 42, as shown. The left hand ends of bracket members 52 are secured to the end of central frame member 47 by means of a horizontal rod or shaft 54.

In FIG. 3, exerciser 41 is shown in one of its inverted, limited positions in which the rear surface 44 of bed 43 rests firmly against the horizontally extended bar or member 36. Horizontal bar 36 provides a limit stop beyond which the bed of exerciser 41 cannot be further inverted. In this position a human body, shown in broken lines, is suspended in an inverted, hanging position, held by the ankle and instep-holding structure 45 and 46. The arms of the body are shown in a downward direction below the head. The position of the center of gravity of the suspended human body, together with exerciser 41, has been preselected such that the center of gravity falls below the horizontally extending pivot axis defined by the pair of slots 22 and to the left of a vertical plane passing through the horizontally extending pivot axis. This position is referred to as the inverted and unlocked body position of the exerciser. From this inverted position, the user can return to a inclined or to a horizontal body position by simply moving the arms from below the head to a position approaching the side of the body. From the horizontal body position, the user, by further shifting the hand and arms toward the feet and raising the head, can return to an upright position with the lower end of central frame member 47 at rest upon the floor.

To achieve an inverted and locked body position, as illustrated in FIG. 4, the user need only position the left and right trunions 51 of exerciser 41 within the pair of slots 23 of trunion supporting plates 21 prior to positioning himself upon the exerciser. By slowly positioning the arms and hands from the exerciser. By slowly positioning the arms and hands from the sides to a position above the head, the exerciser may be tilted from a horizontal body position on through an inclined body position until an inverted body position is achieved. As shown in FIG. 4, the rear surface 44 of bed 43 is firmly pressed against limit stop bar 36. The position of the center of gravity of the suspended human body together with exerciser 41 has been preselected such that the center of gravity falls below the horizontally extending pivot axis and to the right of a vertical plane passing through the horizontally extending pivot axis defined by the pair of slots 23.

When in this locked body position, the user may extend his arms horizontally or even raise his head and body without unlocking the inverted position of exerciser 41. In other words, the bed 43 remains in the position as shown in FIG. 4, with its rear surface 44 firmly pressing against stop bar 36 while the user maneuvers his body in a variety of exercises from the suspended, hanging position.

For the user to return to an inclined, or horizontal, body position from the locked position as shown in FIG. 4, it is necessary that he grasp one of the left or right front legs 26 of A-frame 31 with one hand, grasp the side of bed 43 with the other hand, and then forcibly separate bed 43 from stop bar 36, thereby causing the position of the center of gravity of the human body to shift back to the left of a vertical plane passing through the horizontally extending pivot axis defined by the pair of slots 23. From the horizontal body position, the user can return to the upright position of the exerciser, as described above in connection with FIG. 3.

The present invention provides a simple and effective support structure enabling a tiltable body exerciser to suspend the human body in either of two limited inverted positions, one being an unlocked inverted body position and the other being a locked inverted body position. It is apparent that the invention is not limited to the use of an A-frame stand since any other support structure providing a first and a second spaced-apart pivot support system, as described herein, would be satisfactory.

It is further apparent that the invention is not limited to tiltable body exercisers pivotally supported by trunions, nor to supporting stands using trunion supporting plates. If a tiltable body exerciser can be pivotally shifted from a first horizontally extending pivot axis to a second, spaced-apart horizontally extending pivot axis to achieve the two limited inverted positions as described, it is believed to fall within the spirit and scope of the invention.

Since many changes may be made in the above-described apparatus and many different embodiments of this invention could be made without departing from the scope thereof, it is intended that all matter contained in the above description or shown in the accompanying drawings shall be interpreted as illustrative and not in a limiting sense.

What is claimed is:

1. A support structure for pivotally supporting a tiltable body exerciser about a first or a second horizontally extending pivot axis, said tiltable body exerciser having centrally located, left and right, oppositely extending trunions, comprising in combination:

(a) left and right spaced-apart trunion support members;

(b) a first pair of left and right trunion receiving means located, respectively, in said left and right spaced-apart trunion support members, said first pair of left and right trunion receiving means being adapted for receiving and supporting, respectively, the left and right, oppositely extending trunions of said tiltable body exerciser for tilting movement of said tiltable body exerciser about a first horizontally extending pivot axis; and (c) a second pair of left and right trunion receiving means located, respectively, in said left and right, spaced-apart trunion support members, said second pair of left and right trunion receiving means being adapted for receiving and supporting, respectively, the left and right oppositely extending trunions of said tiltable body exerciser for tilting movement of said exerciser about a second horizontally extending pivot axis parallel to and spaced apart from said first horizontally extending pivot axis.

2. The support structure for pivotally supporting a tiltable body exerciser, as defined by claim 1, further comprising a limit stop member attached to the support structure for limiting the amount of the tilting movement of said tiltable body exerciser, said tiltable body exerciser being tiltable to a first limiting position against said limit stop member when the left and right trunions are positioned in said first pair of left and right trunion receiving means, respectively, said tiltable body exerciser being tiltable to a second limiting position against said limit stop member when the left and right trunions are positioned in said second pair of left and right trunion receiving means, respectively.

3. The support structure for pivotally supporting a tiltable body exerciser as defined in claim 1 wherein said left and right spaced-apart trunion support members include left and right spaced-apart plate members, and wherein said first and second pairs of left and right trunion receiving means include first and second pairs of left and right U-shaped slots located, respectively, in said left and right spaced-apart trunion support members.

4. A support structure for pivotally supporting a tiltable body exerciser about a first or a second horizontally extending pivot axis, said tiltable body exerciser having centrally located, left and right, oppositely extending trunions, comprising in combination:

(a) left and right pairs of spaced-apart leg members mechanically intercoupled to form a sturdy A-frame supporting stand, each of said left and right pairs of leg members having upwardly extending end portions;

(b) a left trunion supporting plate attached to the upwardly extending end portions of said left pair of leg members of said A-frame;

(c) a right trunion supporting plate attached to the upwardly extending end portion of said right pair of leg members of said A-frame;

(d) a first pair of left and right trunion receiving means located, respectively, in said left and right trunion supporting plates;

(e) a second pair of left and right trunion receiving means located, respectively, in said left and right trunion supporting plates; and (f) a limit stop member attached to at least one of the leg members of said left and right pairs of spaced-apart leg members, said limit stop member providing a limit to the amount of tilting movement of said tiltable body exerciser, said tiltable body exerciser being tiltable to a first inverted, limited position when the left and right trunions are positioned, respectively, in said first pair of left and right trunion receiving means and being tiltable to a second inverted, limited position when the left and right trunions are positioned, respectively, in said second pair of left and right trunion receiving means.

5. A support structure for pivotally supporting a tiltable body exerciser about a first or a second spaced-apart horizontally extending pivot axis, said tiltable body exerciser including a structural member by which the tiltable body exerciser may be pivotally supported, comprising in combination:

(a) a pair of spaced-apart upwardly extending support members having upper and lower end portions, the lower end portions being securely joined one with respect to the other to form a sturdy upright support structure;

(b) means associated with the upper end portions of said pair of upwardly extending support members for pivotally receiving the structural member by which the tiltable body exerciser may be pivotally supported, said means providing a first and a second pivot support position, said first pivot support position defining a first horizontally extending pivot axis, said second pivot support position defining a second horizontally extending pivot axis spaced apart from said first horizontally extending axis, the structural member by which the tiltable body exerciser may be pivotally supported being received in either one of said first or second pivot support positions; and (c) stop means attached to at least one of said pair of upwardly extending support members for limiting the amount of tilting movement of the tiltable body exerciser, the tiltable body exerciser being tiltable to a first inverted limited position about said first horizontally extending axis when the structural member is received in said first pivot support position, the tiltable body exerciser being tiltable to a second inverted limited position about said second horizontally extending axis when the structural member is received in said second pivot position.

* * * * *